US008514138B2

(12) United States Patent
Hung et al.

(10) Patent No.: US 8,514,138 B2
(45) Date of Patent: Aug. 20, 2013

(54) MEANDER SLOT ANTENNA STRUCTURE AND ANTENNA MODULE UTILIZING THE SAME

(75) Inventors: Kuo-Fong Hung, Changhua (TW); Ming-Hao Yeh, Taipei (TW)

(73) Assignee: Mediatek Inc., Hsin-Chu (TW)

( * ) Notice: Subject to any disclaimer, the term of this patent is extended or adjusted under 35 U.S.C. 154(b) by 338 days.

(21) Appl. No.: 13/005,366

(22) Filed: Jan. 12, 2011

(65) Prior Publication Data

US 2012/0176292 A1 Jul. 12, 2012

(51) Int. Cl.
*H01Q 13/10* (2006.01)
*H01Q 1/48* (2006.01)

(52) U.S. Cl.
USPC ..... 343/767; 343/700 MS; 343/846; 343/770; 343/829

(58) Field of Classification Search
None
See application file for complete search history.

(56) References Cited

U.S. PATENT DOCUMENTS

| | | | | |
|---|---|---|---|---|
| 6,593,891 | B2 * | 7/2003 | Zhang | 343/767 |
| 6,618,020 | B2 * | 9/2003 | Wang et al. | 343/767 |
| 6,774,850 | B2 | 8/2004 | Chen | |
| 6,940,460 | B2 * | 9/2005 | Maoz et al. | 343/702 |
| 7,450,072 | B2 | 11/2008 | Kim et al. | |
| 7,518,557 | B2 * | 4/2009 | Lin et al. | 343/700 MS |
| 2009/0033577 | A1 * | 2/2009 | Kim et al. | 343/767 |
| 2009/0046027 | A1 * | 2/2009 | Lin et al. | 343/756 |
| 2009/0079647 | A1 * | 3/2009 | Jung et al. | 343/767 |
| 2009/0231215 | A1 | 9/2009 | Taura | |
| 2009/0256765 | A1 * | 10/2009 | Lu et al. | 343/767 |
| 2010/0053022 | A1 | 3/2010 | Mak et al. | |
| 2010/0188294 | A1 | 7/2010 | Chung et al. | |
| 2010/0277261 | A1 * | 11/2010 | Hung et al. | 333/21 A |
| 2011/0188552 | A1 | 8/2011 | Yoon et al. | |

FOREIGN PATENT DOCUMENTS

| | | |
|---|---|---|
| EP | 2 003 728 | 12/2008 |
| JP | A 199623224 | 1/1996 |
| JP | A 2002325015 | 11/2002 |
| JP | 2003-234615 | 8/2003 |
| JP | A 200415160 | 1/2004 |
| JP | A 2004147327 | 5/2004 |
| JP | A 2005510927 | 4/2005 |
| WO | WO 2003/047025 | 6/2003 |
| WO | WO 2004/038859 | 5/2004 |
| WO | WO 2004/105182 | 12/2004 |
| WO | WO 2007/058230 | 5/2007 |

OTHER PUBLICATIONS

English language translation of abstract of JP 2003-234615 (published Aug. 22, 2003).

(Continued)

*Primary Examiner* — Trinh Dinh
(74) *Attorney, Agent, or Firm* — McClure, Qualey & Rodack, LLP

(57) ABSTRACT

A meander slot antenna structure for transmitting a wireless signal is provided. The meander slot antenna structure includes a substrate, a ground element, a feed conductor and a couple conductor. The substrate includes a first surface and a second surface, wherein the first surface is opposite to the second surface. The ground element is disposed on the second surface, wherein a meander slot is formed in the ground element. The feed conductor is disposed on the first surface, wherein the feed conductor corresponds to the meander slot. The couple conductor is disposed on the first surface and coupled with the feed conductor, wherein a via passes through the substrate and electrically connects the couple conductor to the ground element.

23 Claims, 12 Drawing Sheets

(56) References Cited

OTHER PUBLICATIONS

English language translation of abstract of JPA 199623224 (published Jan. 23, 1996).

English language translation of abstract of JPA 2002325015 (published Nov. 8, 2002).

English language translation of abstract of JPA 200415160 (published Jan. 15, 2004).

* cited by examiner

MEANDER SLOT ANTENNA STRUCTURE AND ANTENNA MODULE UTILIZING THE SAME

BACKGROUND OF THE INVENTION

1. Field of the Invention

The present invention relates to a slot antenna structure, and in particular, relates to a meander slot antenna structure with decreased dimensions and improved isolation.

2. Description of the Related Art

FIG. 1A shows a conventional PIFA antenna module 1 comprising a first PIFA antenna unit 10 and a second PIFA antenna unit 20. The first PIFA antenna unit 10 is F shaped with a first feed conductor 11, a first radiator 12 and a first short element 13. The first feed conductor 11 is connected to the first radiator 12, the first short element 13 is connected to the first radiator 12, and the first short element 13 is grounded. The second PIFA antenna unit 20 is F shaped with a second feed conductor 21, a second radiator 22 and a second short element 23. The second feed conductor 21 is connected to the second radiator 22, the second short element 23 is connected to the second radiator 22, and the second short element 23 is grounded. A first signal is fed to the first feed conductor 11 of the first PIFA antenna unit 10 at a first port 14, and a second signal is fed to the second feed conductor 21 of the second PIFA antenna unit 20 at a second port 24. The conventional PIFA antenna module 1 has large dimensions (about 25×20 $mm^2$ when transmitting a wireless signal of 2.5~2.7 GHz) and poor isolation between the first port 14 and the second port 24 (S(2,1), about −5.2 dB, as shown in FIG. 1B).

BRIEF SUMMARY OF THE INVENTION

In one embodiment, a meander slot antenna structure for transmitting a wireless signal is provided. The meander slot antenna structure includes a substrate, a ground element, a feed conductor and a couple conductor. The substrate includes a first surface and a second surface, wherein the first surface is opposite to the second surface. The ground element is disposed on the second surface, wherein a meander slot is formed in the ground element. The feed conductor is disposed on the first surface, wherein the feed conductor corresponds to the meander slot. The couple conductor is disposed on the first surface and coupled with the feed conductor, wherein a via passes through the substrate and electrically connects the couple conductor to the ground element.

In another embodiment of the invention, an antenna module for transmitting a wireless signal is provided. The antenna module includes a substrate, a ground element, a first feed conductor and a second feed conductor. The substrate includes a first surface and a second surface, wherein the first surface is opposite to the second surface. The ground element is disposed on the second surface, wherein a first meander slot and a second meander slot are formed in the ground element, a central line is located between the first meander slot and the second meander slot, the first meander slot has a first isolation portion, the second meander slot has a second isolation portion, the first isolation portion and the second isolation portion extend toward the central line, and a gap is formed between the first isolation portion and the second isolation portion. The first feed conductor is disposed on the first surface, wherein the first feed conductor corresponds to the first meander slot. The second feed conductor is disposed on the first surface, wherein the second feed conductor corresponds to the second meander slot.

Utilizing the antenna module of the second embodiment, the isolation between the first and second feed conductors (S(2,1)) can be improved to −9 dB. Additionally, the dimensions of the antenna module can be reduced to 10×17 $mm^2$ when transmitting a wireless signal of 2.5~2.7 GHz.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1A:
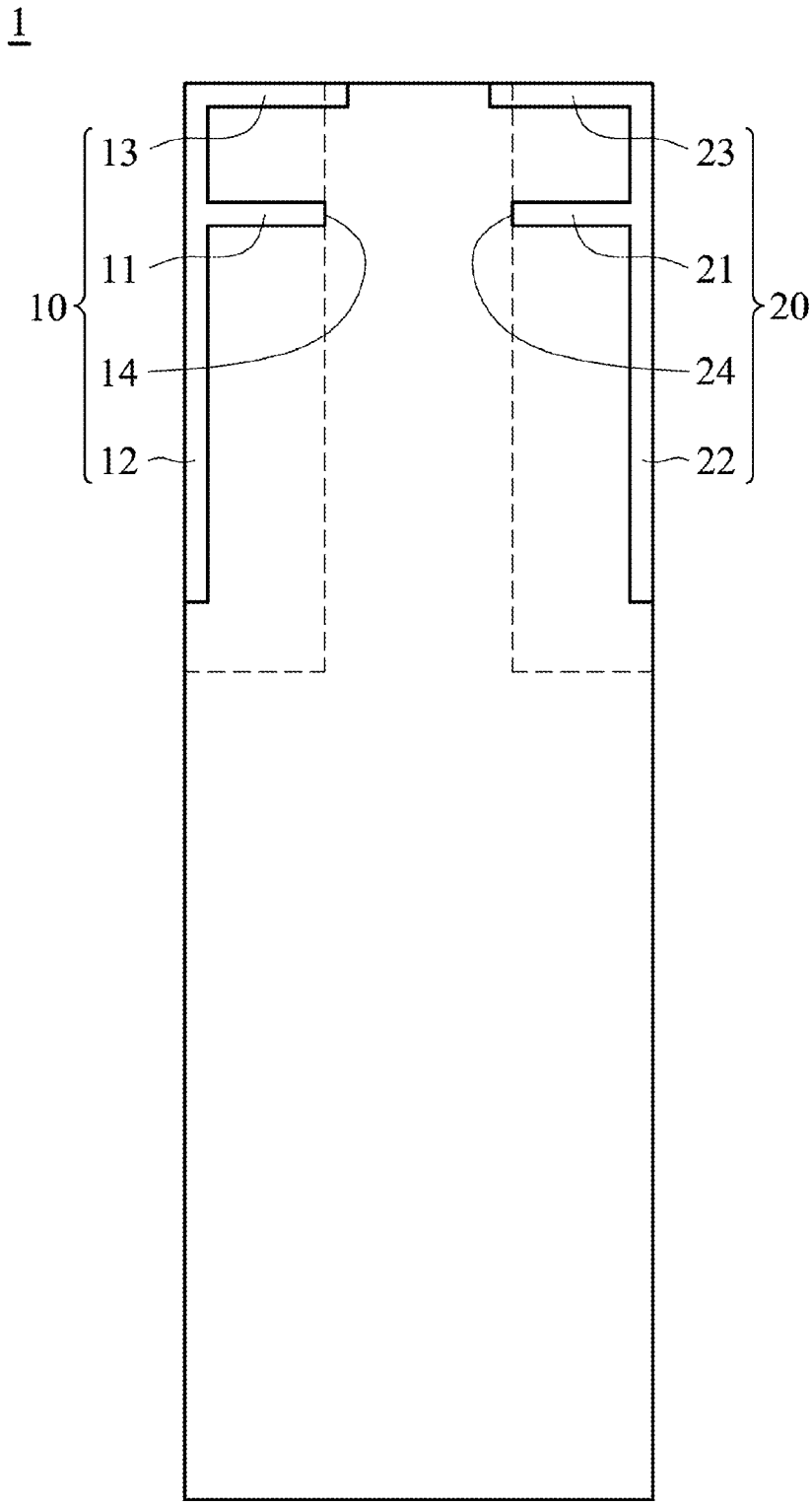
FIG. 1A shows a conventional PIFA antenna module.
Figure 1B:
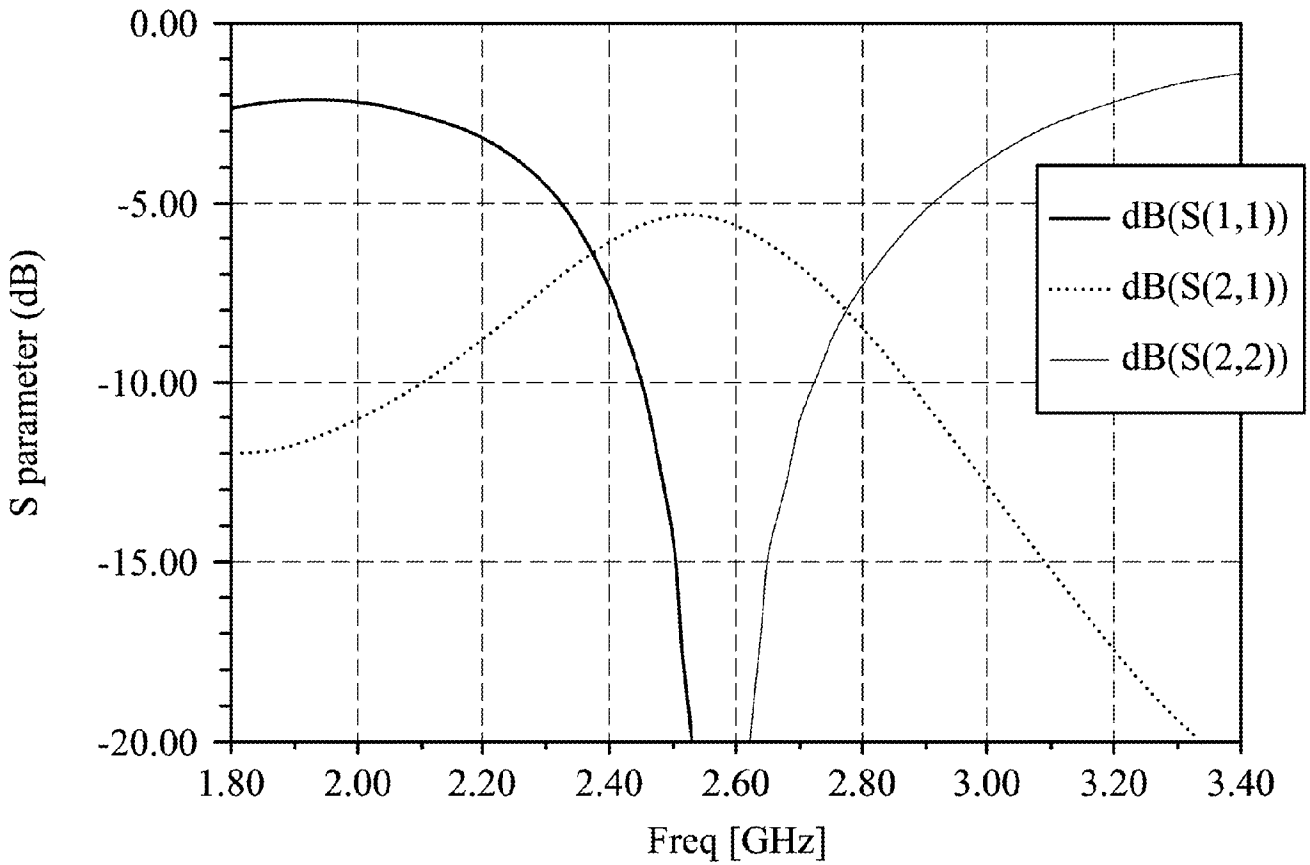
FIG. 1B shows the S parameter of a conventional PIFA antenna module.
Figure 2A:
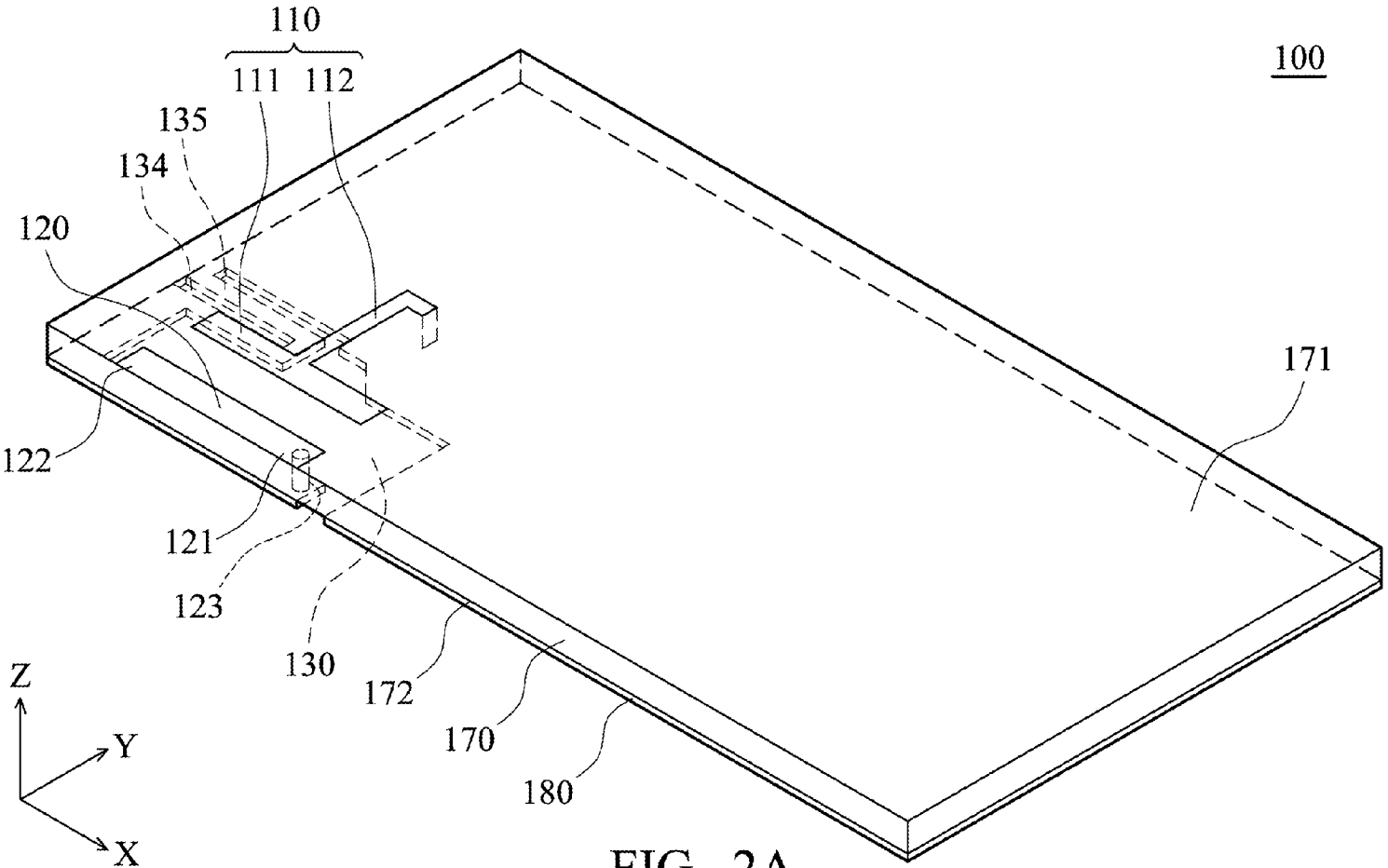
FIG. 2A is a perspective view of a meander slot antenna structure of a first embodiment of the invention.
Figure 2B:
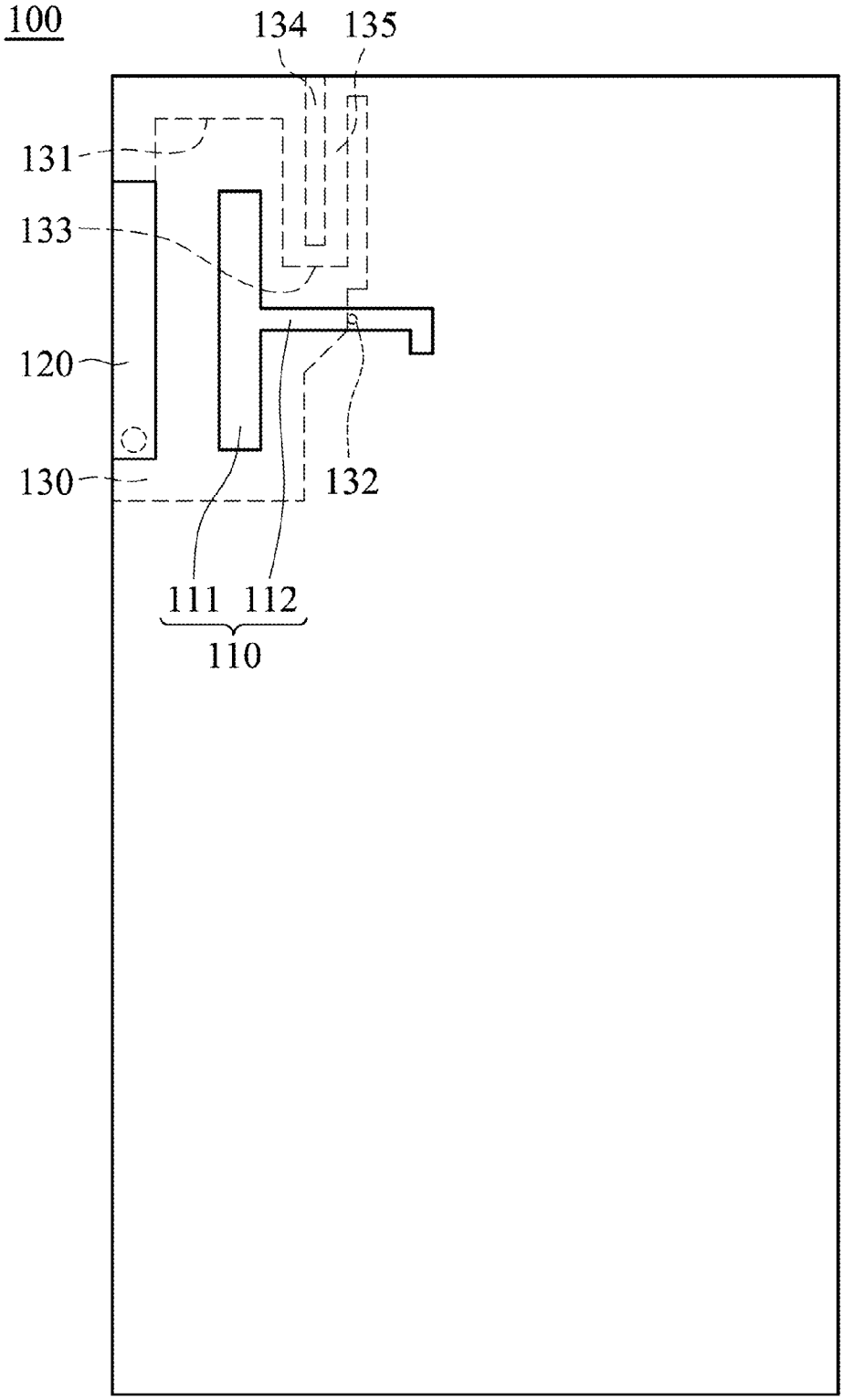
FIG. 2B is a top view of the meander slot antenna structure of the first embodiment of the invention.

FIGS. 2A and 2B show a meander slot antenna structure 100 of a first embodiment of the invention, which has decreased dimensions. Refer to FIG. 2A. The meander slot antenna structure 100 is for transmitting a wireless signal, and includes a substrate 170, a ground element 180, a feed conductor 110 and a couple conductor 120. The substrate 170 includes a first surface 171 and a second surface 172, wherein the first surface 171 is opposite to the second surface 172. The ground element 180 is disposed on the second surface 172, wherein a meander slot 130 is formed in the ground element 180. The feed conductor 110 is disposed on the first surface 171, wherein the feed conductor 110 corresponds to the meander slot 130. The couple conductor 120 is disposed on the first surface 171 and coupled with the feed conductor 110, wherein a via 123 passes through the substrate 170 and electrically connects the couple conductor 120 to the ground element 180.

The couple conductor 120 is disposed longitudinally. The couple conductor 120 comprises a connection end 121 and a free end 122, and the via 123 is connected to the connection end 121.

Refer to FIG. 2B. The feed conductor 110 comprises a coupling portion 111 and a feed portion 112, the coupling portion 111 is connected to an end of the feed portion 112, and the feed conductor 110 is T-shaped. The coupling portion 111 is disposed longitudinally and parallel to the couple conductor 120. The coupling portion 111 is totally inside a projection area of the meander slot 130, and the feed portion 112 overlaps with a resonance path edge 131 of the meander slot 130 at a feed point 132. The couple conductor 120 extends along a portion of the resonance path edge 131.

Figure 3A:
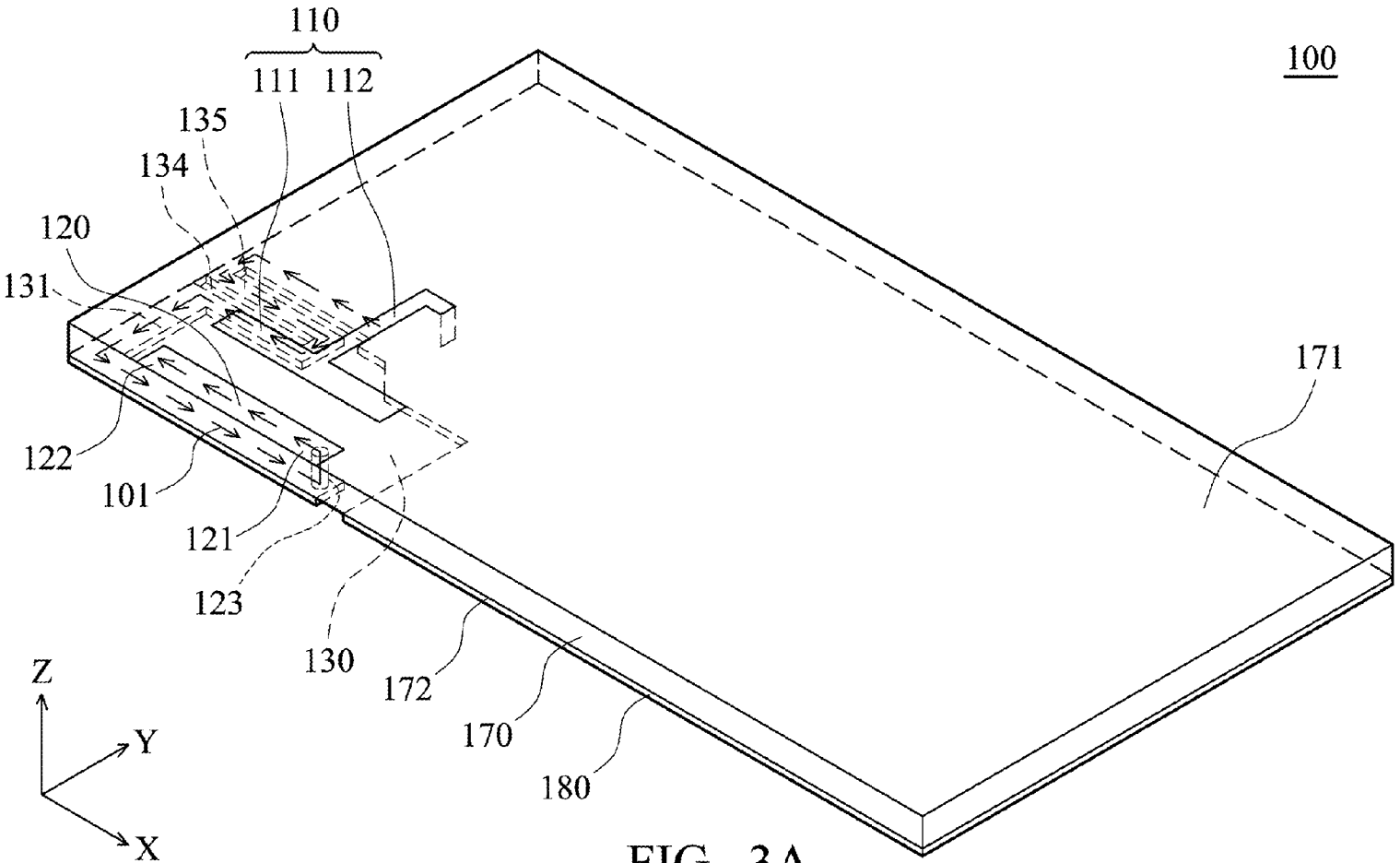
FIGS. 3A and 3B show the path traveled of a reverse current generated when the meander slot antenna structure transmits a wireless signal.
Figure 3B:
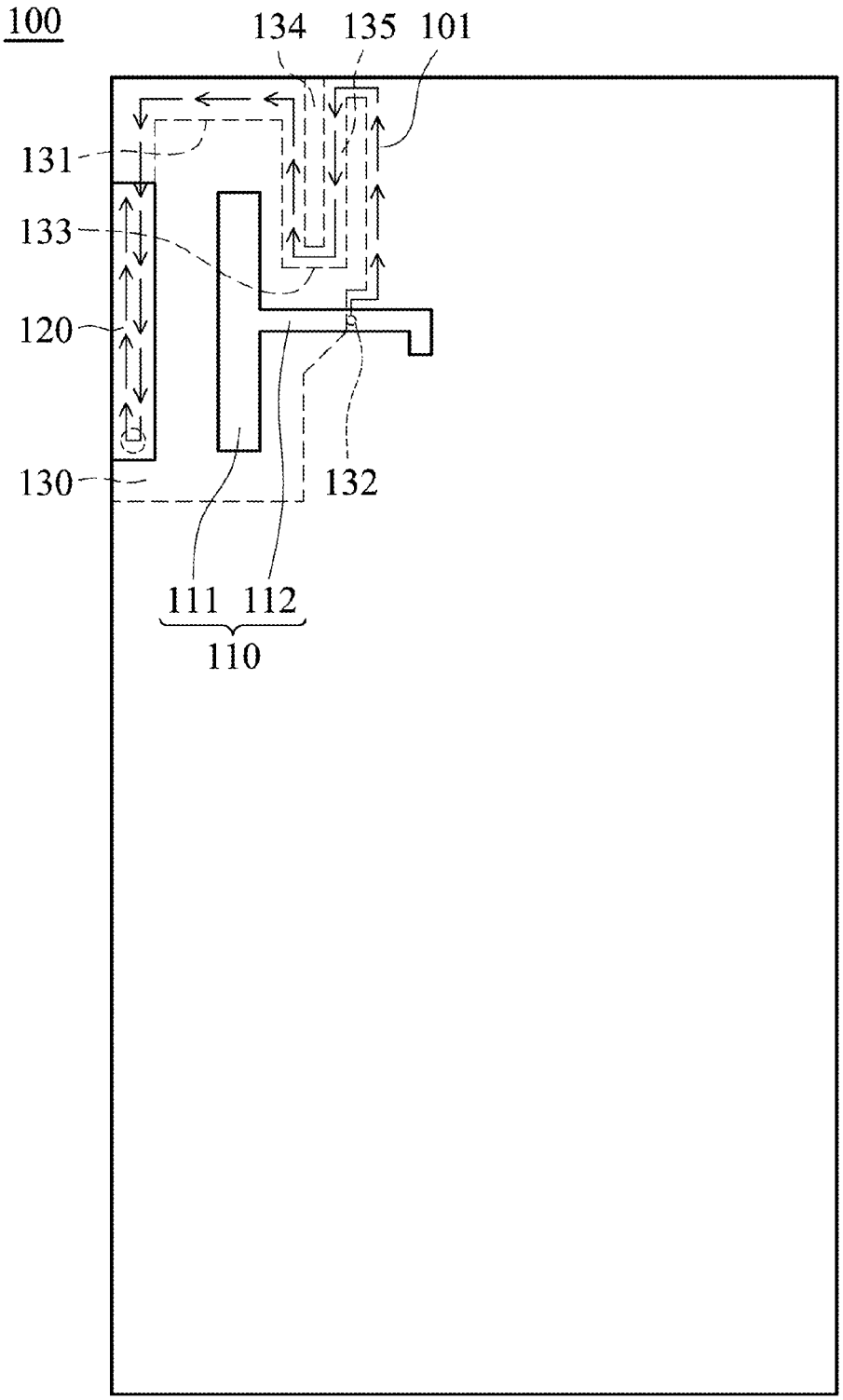

FIGS. 3A and 3B show the path traveled of a reverse current 101 generated when the meander slot antenna structure 100 transmits the wireless signal. As shown in FIGS. 3A and 3B, when a signal is fed to the feed conductor 110, the feed conductor 110 couples to the couple conductor 120. The reverse current 101 is generated and travels on the resonance path edge 131 of the meander slot 130. The reverse current 101 travels from the feed point 132, along the resonance path edge 131, passes through the via 123 to the couple conductor 120, and travels along the couple conductor 120 to the free end 122. In the embodiments of the invention, a length of the path traveled (including the resonance path edge 131, the via 123 and the couple conductor 120) of the reverse current is $\lambda/4$, and $\lambda$ is the wavelength of the wireless signal. By designing the length of the path traveled as $\lambda/4$, the reverse current 101 travels and resonates on the path traveled to transmit the wireless signal. Additionally, the coupling portion 111 of the feed conductor 110 couples to the couple conductor 120 to guide the reverse current 101 travel along the path and improve transmission effect of the meander slot antenna structure 100.

As shown in FIG. 3B, the resonance path edge 131 comprises a U-shaped portion 133. A partition slot 134 is formed in the ground element 180, the U-shaped portion 133 forms a notch 135, and the partition slot 134 is inserted into the notch 135. The U-shaped portion 133 twists the path traveled of the reverse current 101 to further decrease the dimensions of the meander slot antenna structure 100. In the first embodiment, the dimensions of the meander slot antenna structure 100 is reduced.

Figure 4A:
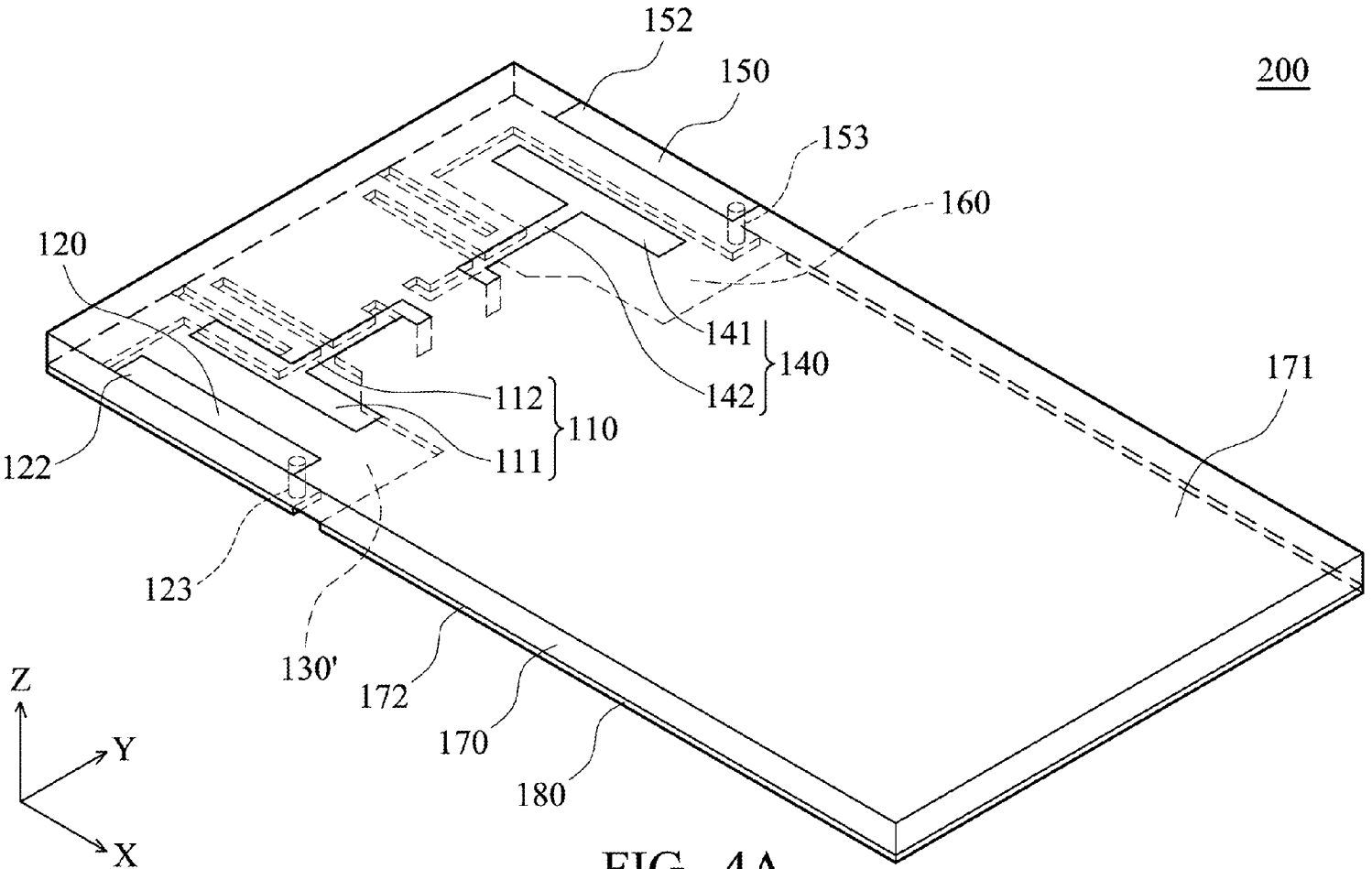
FIG. 4A is a perspective view of an antenna module of a second embodiment of the invention.
Figure 4B:
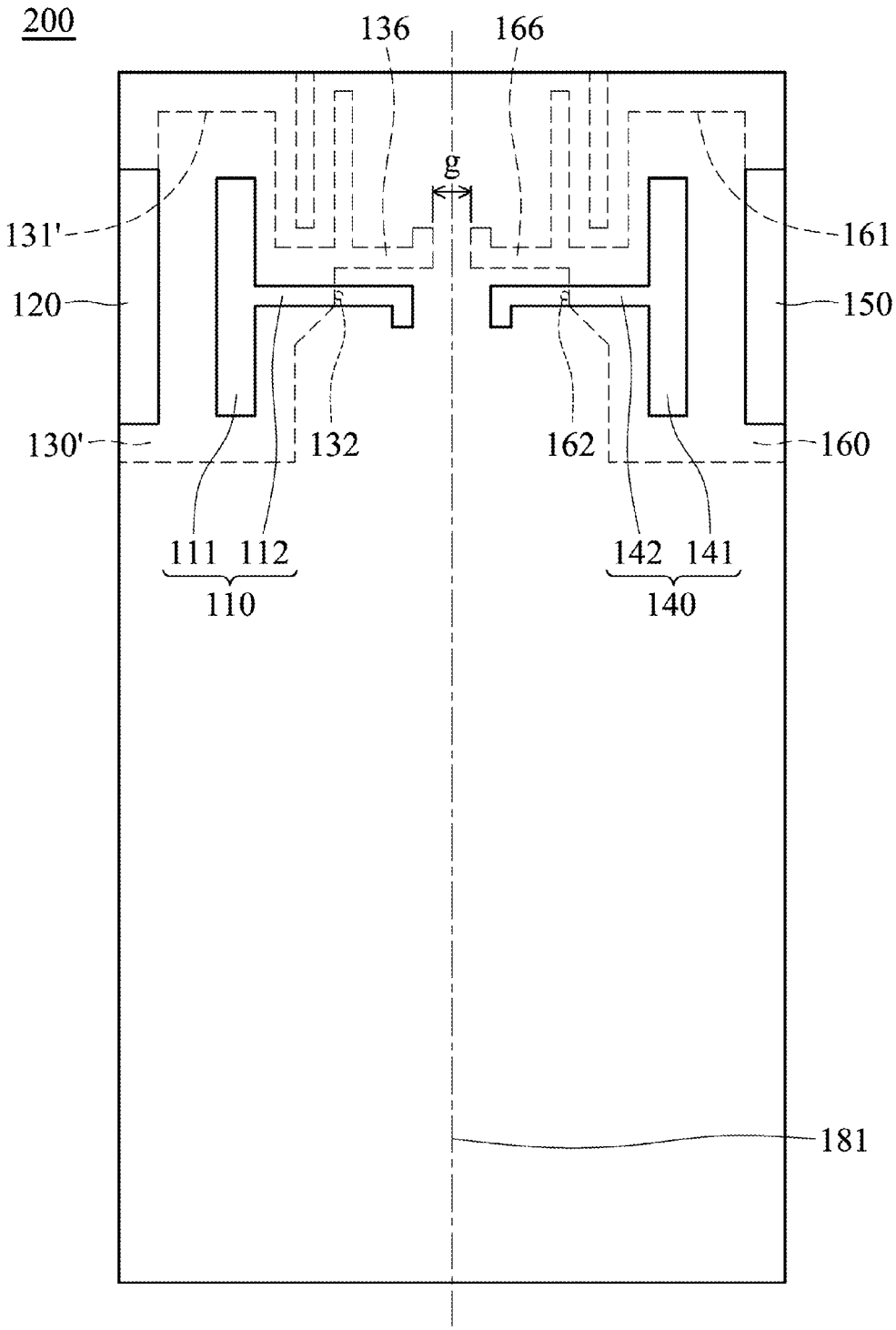
FIG. 4B is a top view of the antenna module of the second embodiment of the invention.

FIGS. 4A and 4B show an antenna module 200 of a second embodiment for transmitting a wireless signal. The antenna module 200 includes a substrate 170, a ground element 180, a first feed conductor 110, a first couple conductor 120, a second feed conductor 140 and a second couple conductor 150. The substrate 170 includes a first surface 171 and a second surface 172, wherein the first surface 171 is opposite to the second surface 172. The ground element 180 is disposed on the second surface 172, wherein a first meander slot 130' and a second meander slot 160 are formed in the ground element 180, and a central line 181 (FIG. 4B) is located between the first meander slot 130' and the second meander slot 160. Note that the central line 181 is drawn for clarification, and no physical object is formed thereon or therewith. The first feed conductor 110 is disposed on the first surface 171, wherein the first feed conductor 110 corresponds to the first meander slot 130'. The first couple conductor 120 is disposed on the first surface 171 and coupled with the first feed conductor 110, wherein a first via 123 passes through the substrate 170 and electrically connects the first couple conductor 120 to the ground element 180. The second feed conductor 140 is disposed on the first surface 171, wherein the second feed conductor 140 corresponds to the second meander slot 160. The second couple conductor 150 is disposed on the first surface 171 and coupled with the second feed conductor 140, wherein a second via 153 passes through the substrate 170 and electrically connects the second couple conductor 150 to the ground element 180. The antenna module 200 may be considered as a single input/multiple output (SIMO), a multiple input/single output (MISO), or a multiple input/multiple output (MIMO) antenna module. Wireless communications devices use the antenna module 200 to improved performance. When two transmitters and two or more receivers are used, two simultaneous data streams may be sent via the antenna module 200, which double the data rate. Multiple receivers alone with the antenna module 200 allow greater distances between devices. For example, the IEEE 802.11n (Wi-Fi) wireless standard uses MIMO to increase speed to 100 Mbps and beyond, doubling at minimum the 802.11a and 11g rates. The antenna module 200 may also be used in WiMAX (Worldwide Interoperability for Microwave Access) and LTE (Long Term Evolution) communications devices.

In the second embodiment, the first feed conductor 110 and the first couple conductor 120 are similar to the corresponding elements of the first embodiment, and the first meander slot 130' is also similar to the meander slot 130. The first feed conductor 110, the first couple conductor 120 and the first meander slot 130' are symmetric to the second feed conductor 140, the second couple conductor 150 and the second meander slot 160 to the central line 181. In other words, second feed conductor 140, the second couple conductor 150 and the second meander slot 160 are flipped left to right relative from the first feed conductor 110, the first couple conductor 120 and the first meander slot 130' respectively.

Figure 5A:
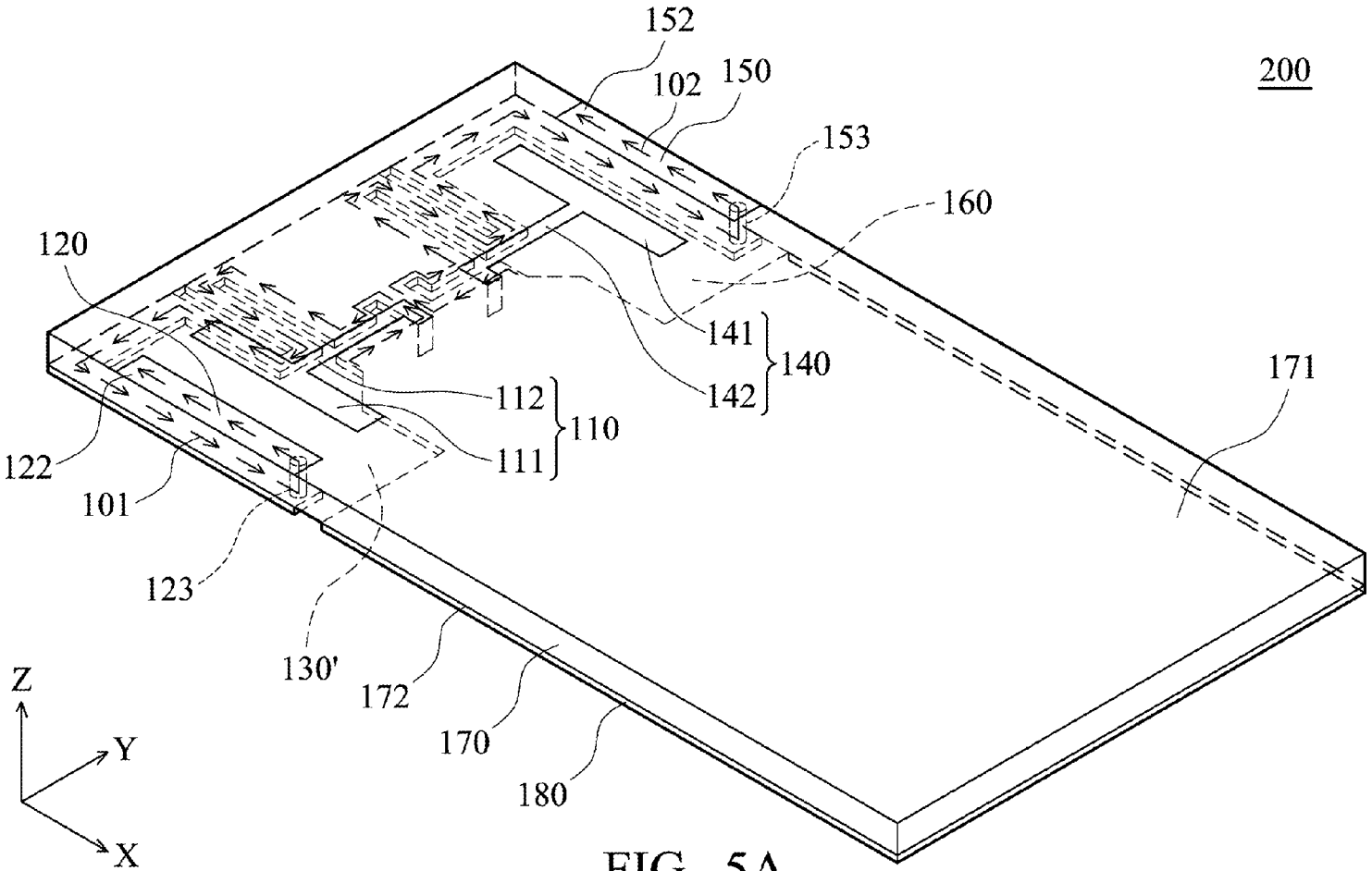
FIGS. 5A and 5B show path traveled of the reverse currents generated when the antenna module transmits wireless signals.
Figure 5B:
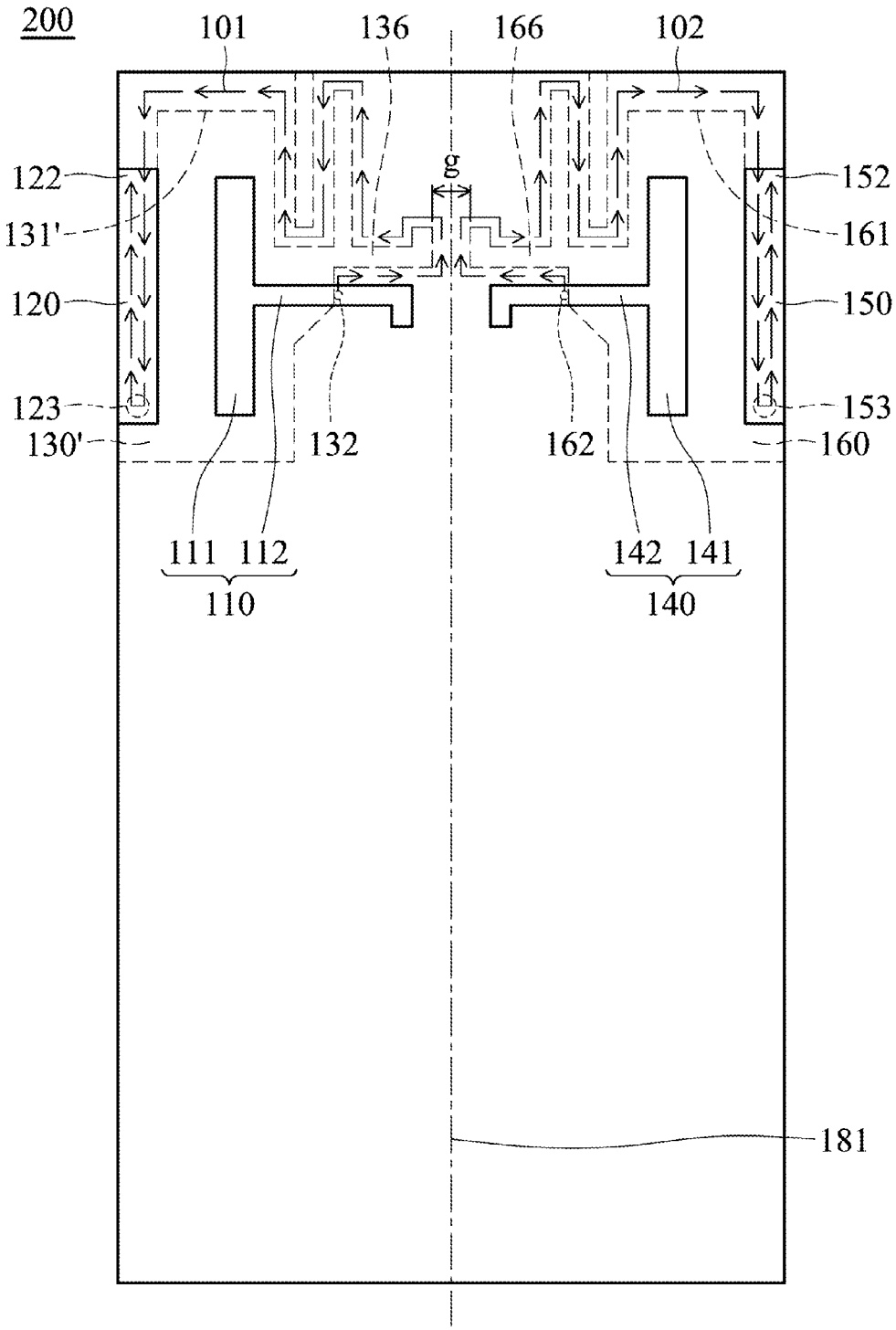

FIGS. 5A and 5B show paths traveled of the reverse currents generated when the antenna module 200 transmits the wireless signal. As shown in FIGS. 5A and 5B, the first meander slot 130' comprises a first resonance path edge 131', and the first feed conductor 110 overlaps with the first resonance path edge 131' at a first feed point 132. The second meander slot 160 comprises a second resonance path edge 161, and the second feed conductor 140 overlaps with the second resonance path edge 161 at a second feed point 162. When the first signal is fed to the first feed conductor 110, a first reverse current 101 travels from the first feed point 132, along the first resonance path edge 131', passes through the first via 123 to the first couple conductor 120, and travels along the first couple conductor 120 to the first free end 122 of the first couple conductor 120. When a second signal is fed to the second feed conductor 140, a second reverse current 102 travels from the second feed point 162, along the second resonance path edge 161, passes through the second via 153 to the second couple conductor 150, and travels along the second couple conductor 150 to a second free end 152 of the second couple conductor 150.

Figure 6:
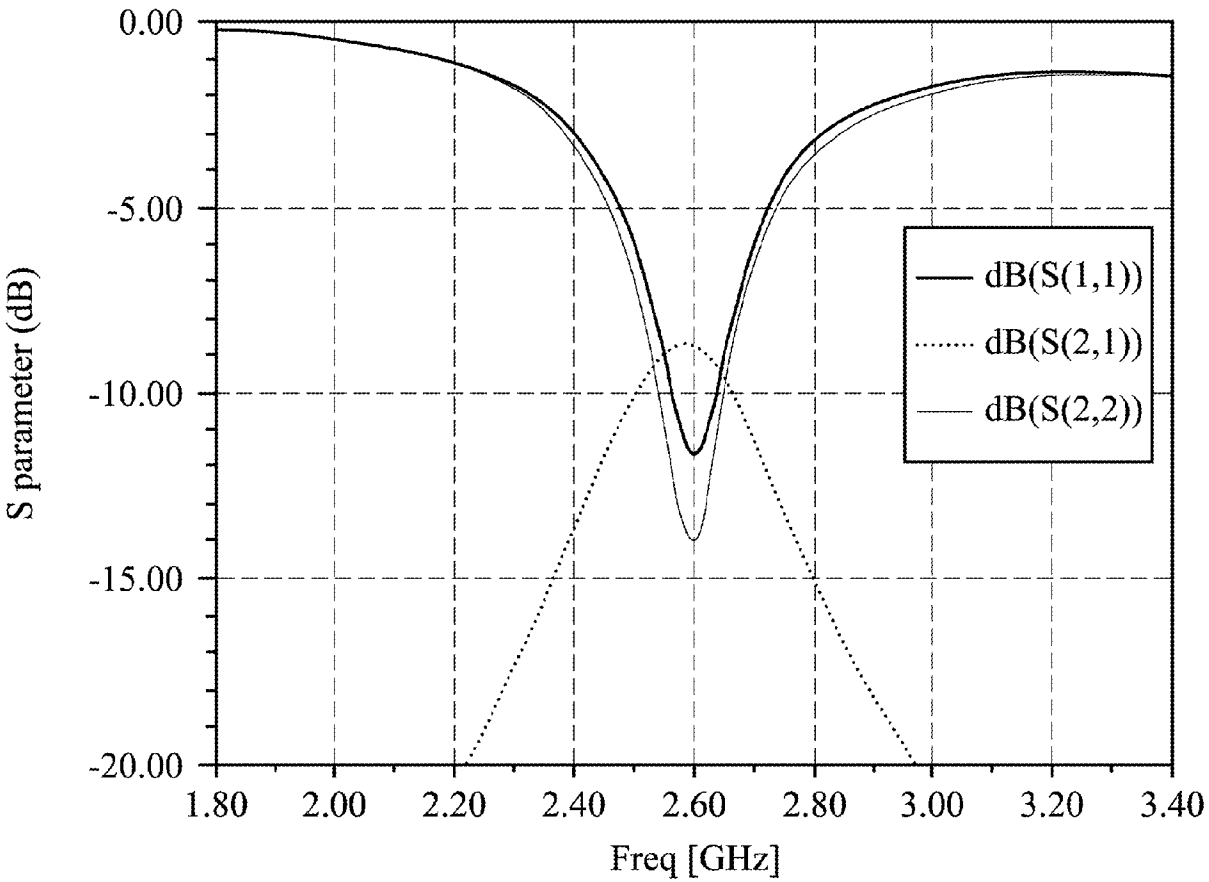
FIG. 6 shows S parameter of the antenna module of the second embodiment.

The first meander slot 130' has a first isolation portion 136 formed on the first resonance path edge 131', the second meander slot 160 has a second isolation portion 166 formed on the second resonance path edge 161, and the first isolation portion 136 and the second isolation portion 166 extend toward the central line 181. A gap g is formed between the first isolation portion 136 and the second isolation portion 166. FIG. 6 shows isolation between the first and second feed conductors (Port 1 and Port 2) of the antenna module 200 of the second embodiment. As shown in FIG. 6, utilizing the antenna module 200 of the second embodiment, the isolation between the first and second feed conductors (S(2,1)) could be improved to −9 dB. Additionally, the dimensions of the antenna module 200 could be reduced to 10×17 $mm^2$ when transmitting a wireless signal of 2.5~2.7 GHz.

Figure 7:
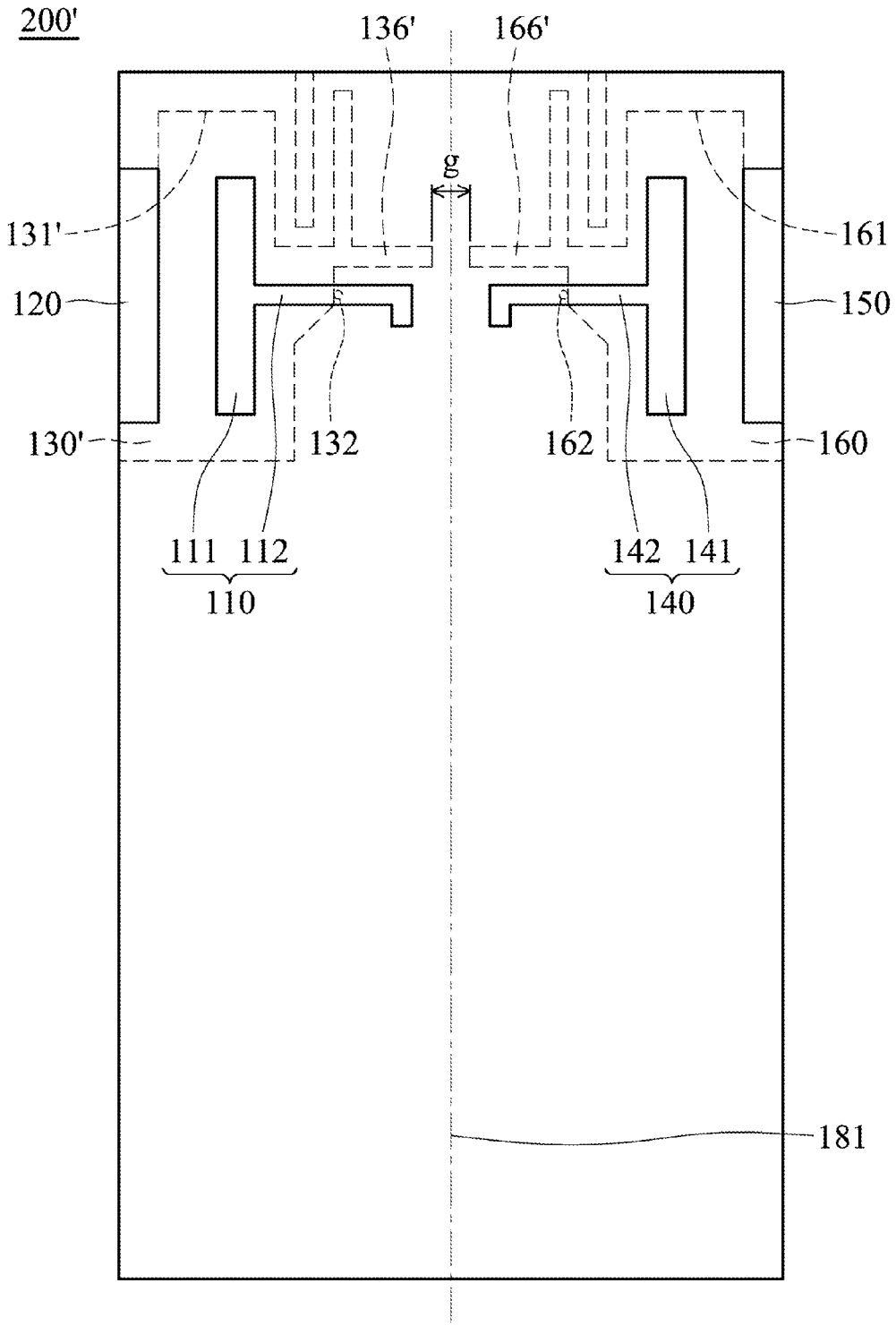
FIG. 7 is a top view of an antenna module of a modified example of the invention.

Refer to FIGS. 5A and 5B. In the second embodiment of the invention, the first isolation portion 136 and the second isolation portion 166 are L-shaped, and arranged symmetric to the central line 181. In other words, the second isolation portion 166 is flipped left to right from the first isolation portion 136. The first isolation portion 136 and the second isolation portion 166 are shorter than λ/8, and λ is the wavelength of the wireless signal. The shapes of the first isolation portion 136 and the second isolation portion 166 can be modified, for example, to be longitudinal. FIG. 7 is a top view of an antenna module of a modified example of the invention, wherein the first isolation portion 136' and the second isolation portion 166' are longitudinal, and arranged on a same line.

The first feed conductor 110 comprises a first coupling portion 111 and a first feed portion 112, and the second feed conductor 140 comprises a second coupling portion 141 and a second feed portion 142, the first feed portion 112 is parallel to the first isolation portion 136, and the second feed portion 142 is parallel to the second isolation portion 166.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A meander slot antenna structure for transmitting a wireless signal, comprising:

a substrate, comprising a first surface and a second surface, wherein the first surface is opposite to the second surface;

a ground element, disposed on the second surface, wherein a meander slot is formed in the ground element;

a feed conductor, disposed on the first surface, wherein the feed conductor corresponds to the meander slot; and a couple conductor, disposed on the first surface and coupled with the feed conductor, wherein a via passes through the substrate and electrically connects the couple conductor to the ground element.

2. The meander slot antenna structure as claimed in claim 1, wherein the couple conductor is disposed longitudinally, the couple conductor comprises a connection end and a free end, and the via is connected to the connection end.

3. The meander slot antenna structure as claimed in claim 2, wherein the meander slot comprises a resonance path edge, the feed conductor overlaps with the resonance path edge at a feed point, and when the meander slot antenna structure transmits the wireless signal, a reverse current travels from the feed point, along the resonance path edge, passes through the via to the couple conductor, and travels along the couple conductor to the free end.

4. The meander slot antenna structure as claimed in claim 3, wherein the length of the path traveled of the reverse current is λ/4, and λ is a wavelength of the wireless signal.

5. The meander slot antenna structure as claimed in claim 3, wherein the resonance path edge comprises a U-shaped portion.

6. The meander slot antenna structure as claimed in claim 5, wherein a partition slot is formed in the ground element, the U-shaped portion forms a notch, and the partition slot is inserted into the notch.

7. The meander slot antenna structure as claimed in claim 3, wherein the couple conductor extends along a portion of the resonance path edge.

8. The meander slot antenna structure as claimed in claim 3, wherein the feed conductor comprises a coupling portion and a feed portion, the coupling portion is connected to an end of the feed portion, and the feed conductor is T-shaped.

9. The meander slot antenna structure as claimed in claim 8, wherein the coupling portion is disposed longitudinally and parallel to the couple conductor.

10. The meander slot antenna structure as claimed in claim 9, wherein the coupling portion is totally inside a projection area of the meander slot, and the feed portion overlaps with the resonance path edge at the feed point.

11. An antenna module for transmitting a wireless signal, comprising:

a substrate, comprising a first surface and a second surface, wherein the first surface is opposite to the second surface;

a ground element, disposed on the second surface, wherein a first meander slot and a second meander slot are formed in the ground element, and a central line is located between the first meander slot and the second meander slot;

a first feed conductor, disposed on the first surface, wherein the first feed conductor corresponds to the first meander slot;

a first couple conductor, disposed on the first surface and coupled with the first feed conductor, wherein a first via passes through the substrate and electrically connects the first couple conductor to the ground element;

a second feed conductor, disposed on the first surface, wherein the second feed conductor corresponds to the second meander slot; and a second couple conductor, disposed on the first surface and coupled with the second feed conductor, wherein a second via passes through the substrate and electrically connects the second couple conductor to the ground element.

12. The antenna module as claimed in claim 11, wherein the first couple conductor and second couple conductor are disposed longitudinally, the first couple conductor comprises a first connection end and a first free end, and the first via is connected to the first connection end, the second couple conductor comprises a second connection end and a second free end, and the second via is connected to the second connection end.

13. The antenna module as claimed in claim 12, wherein the first meander slot comprises a first resonance path edge, the first feed conductor overlaps with the first resonance path edge at a first feed point, the second meander slot comprises a second resonance path edge, the second feed conductor overlaps with the second resonance path edge at a second feed point, when a first signal is fed to the first feed conductor, a first reverse current travels from the first feed point, along the first resonance path edge, passes through the first via to the first couple conductor, and travels along the first couple conductor to the first free end, and when a second signal is fed to the second feed conductor, a second reverse current travels from the second feed point, along the second resonance path edge, passes through the second via to the second couple conductor, and travels along the second couple conductor to the second free end.

14. The antenna module as claimed in claim 13, wherein the first meander slot has a first isolation portion formed on the first resonance path edge, the second meander slot has a second isolation portion formed on the second resonance path edge, the first isolation portion and the second isolation portion extend toward the central line, and a gap is formed between the first isolation portion and the second isolation portion.

15. The antenna module as claimed in claim 14, wherein the first isolation portion and the second isolation portion are longitudinal, and arranged on a same line.

16. The antenna module as claimed in claim 14, wherein the first isolation portion and the second isolation portion are L-shaped, and arranged symmetric to the central line.

17. The antenna module as claimed in claim 14, wherein the first feed conductor comprises a first coupling portion and a first feed portion, the first coupling portion is connected to an end of the first feed portion, the first feed conductor is T-shaped, the second feed conductor comprises a second coupling portion and a second feed portion, the second coupling portion is connected to an end of the second feed portion, the second feed conductor is T-shaped.

18. The antenna module as claimed in claim 17, wherein the first feed portion is parallel to the first isolation portion, and the second feed portion is parallel to the second isolation portion.

19. An antenna module for transmitting a wireless signal, comprising:

a substrate, comprising a first surface and a second surface, wherein the first surface is opposite to the second surface;

a ground element, disposed on the second surface, wherein a first meander slot and a second meander slot are formed in the ground element, a central line is located between the first meander slot and the second meander slot, the first meander slot has a first isolation portion, the second meander slot has a second isolation portion, the first isolation portion and the second isolation portion extend toward the central line, and a gap is formed between the first isolation portion and the second isolation portion;

a first feed conductor, disposed on the first surface, wherein the first feed conductor corresponds to the first meander slot; and a second feed conductor, disposed on the first surface, wherein the second feed conductor corresponds to the second meander slot.

20. The antenna module as claimed in claim 19, wherein the first isolation portion and the second isolation portion are disposed longitudinal, and arranged on a same line.

21. The antenna module as claimed in claim 19, wherein the first isolation portion and the second isolation portion are L-shaped, and arranged symmetric to the central line.

22. The antenna module as claimed in claim 19, wherein lengths of the first isolation portion and the second isolation portion are shorter then $\lambda/8$, and $\lambda$ is the wavelength of the wireless signal.

23. A meander slot antenna structure for transmitting a wireless signal, comprising:

a substrate, comprising a first surface and a second surface, wherein the first surface is opposite to the second surface;

a ground element, disposed on the second surface, wherein a meander slot is formed on the ground element and comprises a resonance path edge;

a feed conductor, disposed on the first surface, wherein the feed conductor corresponds to the meander slot, and the feed conductor overlaps with the resonance path edge at a feed point; and a couple conductor, coupled with the feed conductor and comprising a free end, wherein, and when the meander slot antenna structure transmits the wireless signal, a reverse current travels from the feed point, along the resonance path edge to the couple conductor, and travels along the couple conductor to the free end.

* * * * *